US008146372B2

(12) United States Patent
Carrere et al.

(10) Patent No.: US 8,146,372 B2
(45) Date of Patent: Apr. 3, 2012

(54) GAS TURBINE COMBUSTION CHAMBER HAVING INNER AND OUTER WALLS SUBDIVIDED INTO SECTORS

(75) Inventors: Benoit Carrere, Le Taillan Medoc (FR); Georges Habarou, Le Bouscat (FR); Patrick Spriet, Bruges (FR); Pierre Camy, Saint Medard en Jalles (FR)

(73) Assignee: Snecma Propulsion Solide, Le Haillan (FR)

( * ) Notice: Subject to any disclaimer, the term of this patent is extended or adjusted under 35 U.S.C. 154(b) by 569 days.

(21) Appl. No.: 12/416,418

(22) Filed: Apr. 1, 2009

(65) Prior Publication Data

US 2009/0249790 A1 Oct. 8, 2009

(30) Foreign Application Priority Data

Apr. 3, 2008 (FR) ..... 08 52229

(51) Int. Cl.
*F23R 3/50* (2006.01)

(52) U.S. Cl. ..... 60/804; 60/753; 60/800

(58) Field of Classification Search ..... 60/804, 60/753, 752, 800
See application file for complete search history.

(56) References Cited

U.S. PATENT DOCUMENTS

| | | | | |
|---|---|---|---|---|
| 2,544,538 | A * | 3/1951 | Mahnken et al. | 60/800 |
| 3,956,886 | A | 5/1976 | Sedgwick | |
| 4,158,949 | A | 6/1979 | Reider | |
| 4,907,411 | A | 3/1990 | Krüeger | |
| 6,610,385 | B2 * | 8/2003 | Cairo | 60/753 |
| 6,708,495 | B2 * | 3/2004 | Calvez et al. | 60/753 |
| 2002/0184892 | A1 | 12/2002 | Calvez et al. | |
| 2007/0186558 | A1 * | 8/2007 | De Sousa et al. | 60/804 |

FOREIGN PATENT DOCUMENTS

| | | |
|---|---|---|
| EP | 1635118 A2 | 3/2006 |
| GB | 2432902 A | 6/2007 |

* cited by examiner

*Primary Examiner* — Ted Kim
(74) *Attorney, Agent, or Firm* — Weingarten, Schurgin, Gagnebin & Lebovici LLP

(57) ABSTRACT

An annular combustion chamber has an inner wall and an outer wall of ceramic matrix composite material, together with a chamber end wall that is connected to the inner and outer walls. Elastically-deformable link elements connect the inner wall and the outer chamber walls to inner and outer metal casings. Each of the inner and outer chamber walls is subdivided circumferentially into adjacent sectors along longitudinal edges, each sector extending continuously from the end wall to the opposite end of the chamber and being folded outwards from the chamber at each of its longitudinal edges to form a portion having a U-shaped cross-section terminated by a folded-back margin that is spaced apart from the outer face of the corresponding chamber wall. The link elements are connected to the inner and outer chamber walls by being fastened to the sector margins.

14 Claims, 8 Drawing Sheets

GAS TURBINE COMBUSTION CHAMBER HAVING INNER AND OUTER WALLS SUBDIVIDED INTO SECTORS

BACKGROUND OF THE INVENTION

The invention relates to gas turbines and more particularly to the configuration and the assembly of an annular combustion chamber having inner and outer walls made of ceramic matrix composite (CMC) materials. The fields of application of the invention comprise gas turbine aero-engines and industrial gas turbines.

Proposals have been made to use CMCs for making gas turbine combustion chamber walls because of the thermo-structural properties of CMCs, i.e. because of their ability to conserve good mechanical properties at high temperatures. Higher combustion temperatures are sought in order to improve efficiency and reduce the emission of polluting species, in particular for gas turbine aero-engines, by reducing the flow rate of air used for cooling the walls. The combustion chamber is mounted between inner and outer metal casings by means of link elements that are flexible, i.e. elements that are elastically deformable, thus making it possible to absorb the differential dimensional variations of thermal origin that occur between metal portions and CMC portions. Reference can be made in particular to documents U.S. Pat. Nos. 6,708,495 and 7,234,306.

CMC materials are constituted by refractory fiber reinforcement, e.g. made of carbon fibers or of ceramic fibers, which reinforcement is densified by a ceramic matrix. In order to make a CMC part of complex shape, a fiber preform is prepared of shape that is close to the shape of the part that is to be made, and then the preform is densified. Densification may be performed by a liquid process or by a gas process, or by a combination of both. The liquid process consists in impregnating the preform with a liquid composition that contains a precursor for the ceramic matrix that is to be made, the precursor typically being a resin in solution, and then pyrolytic heat treatment is performed after the resin has been cured. The gas process is chemical vapor infiltration (CVI), which consists in placing the preform in an oven into which a reaction gas phase is introduced to diffuse within the preform and, under predetermined conditions, in particular of temperature and pressure, to form a solid ceramic deposit on the fibers by decomposition of a ceramic precursor contained in the gas phase or by a reaction occurring between components of the gas phase.

Whatever the densification process used, tooling is required to hold the preform in the desired shape, at least during an initial stage of densification for consolidating the preform.

Making annular combustion chamber walls for a gas turbine requires tooling that is complex in shape. Furthermore, when performing densification by CVI, preforms can occupy a large amount of space in a densification oven, and it is highly desirable to optimize the way in which the oven is loaded.

Document U.S. Pat. No. 4,907,411 proposes a combustion chamber in which the walls are subdivided longitudinally and circumferentially into ceramic panels. At their longitudinal ends, the panels are folded back to form channel-section portions and they are supported by annular metal parts that are fastened to an outer metal casing and that engage in the channel-section portions with insulating elements being interposed between them.

Document U.S. Pat. No. 3,956,886 shows combustion chamber walls made in the form of ceramic tiles. The tiles may present folded edges of channel section that are inserted in housings defined by metal parts fastened to inner and outer metal casings, thereby making the assembly somewhat inappropriate in the event of differential expansion.

Document EP 1 635 118 proposes using CMC tiles to make a chamber wall that is exposed to hot gas, which tiles are supported by a support structure that is spaced apart from the chamber wall. The tiles are formed with tabs that extend into the space between the chamber wall and the support structure and that extend through the support structure so as to be connected thereto on the outside. The connections are rigid and occupy significant volume outside the support structure. In addition, the presence of an additional casing is required in order to provide sealing.

OBJECT AND SUMMARY OF THE INVENTION

An object of the invention is to remedy the above-mentioned drawbacks, and for this purpose, the invention provides a gas turbine combustion chamber assembly comprising: an inner metal casing; an outer metal casing; an annular combustion chamber having an inner wall and an outer wall of ceramic matrix composite material and a chamber end wall connected to the inner and outer walls; and elastically-deformable link elements connecting the inner wall and the outer wall of the chamber respectively to the inner metal casing and to the outer metal casing, in which assembly, in accordance with the invention, each of the inner and outer walls of the chamber is subdivided circumferentially into adjacent sectors along longitudinal edges, each sector extending continuously from the chamber end wall to the opposite end of the chamber, each sector being folded outwards from the chamber via each of its longitudinal edges so as to form a portion having a U-shaped cross-section, each terminated by a folded-back margin that is spaced apart from the outer face of the corresponding chamber wall, and the link elements are connected to the inner and outer walls of the chamber by being fastened to the margins of the sectors.

Subdividing the combustion chamber walls into sectors makes it possible to limit the size of the parts that are to be made and to limit the complexity of their shapes, thereby significantly reducing the cost of fabricating them. Furthermore, differential variation in dimensions between the metal casings and the CMC combustion chamber walls can be accommodated easily and effectively by the elastic deformation of the link elements and by the flexibility of the folded-back longitudinal edges of the chamber sectors. In addition, the link elements are disposed in the gap between the chamber walls and the metal casings, where they are cooled by the flow of air flowing around the chamber.

Advantageously, the link elements are in the form of bridges of substantially omega-shaped section, each bridge having a top that is connected to one of the inner and outer metal casings, and feet that are connected to adjacent margins of two adjacent sectors of the corresponding inner or outer chamber wall. Thus, the link elements contribute to providing connections between adjacent chamber wall sectors.

Advantageously, the link elements are fastened to the outer faces of the margins of the sectors, i.e. at a location that is further away from the inner faces of the sectors that are exposed to the highest temperatures.

In a particular embodiment, each inner or outer chamber wall sector is connected via each of its margins to the corresponding inner or outer metal casing by means of a first and at least one second link element. The connection between the or each second link element and the corresponding chamber wall sector margin is then provided with slack in the longitudinal direction.

Preferably, sealing gaskets are interposed between adjacent inner or outer chamber wall sectors, e.g. by being interposed between the facing rounded portions of the folded-back longitudinal edges of two adjacent sectors.

Each gasket may present a section of X- or 8-shape.

Advantageously, each gasket comprises a fiber structure of refractory fibers, which may be densified at least in part by a ceramic material.

Also advantageously, elements are provided for holding each gasket in the longitudinal direction relative to the longitudinal edges of the chamber wall sectors between which the gasket is placed.

In a particular embodiment, the chamber end wall includes inner and outer annular flanges having the inner and outer chamber wall sectors connected thereto.

Each chamber wall sector may be made integrally with a portion forming a cowl sector that extends upstream from the connection between the sector and the chamber end wall.

In a variant, cowl-forming portions extend the inner and outer chamber walls upstream from the connection with the chamber end wall, which cowl-forming portions are distinct from the chamber wall sectors and are fastened to the inner and outer annular flanges of the chamber end wall.

The invention also provides a gas turbine aero-engine provided with a combustion chamber assembly as defined above.

BRIEF DESCRIPTION OF THE DRAWINGS

The invention can be better understood on reading the following description given by way of non-limiting indication with reference to the accompanying drawings, in which.

DETAILED DESCRIPTION OF AN EMBODIMENT

Embodiments of the invention are described below in the context of its application to a gas turbine airplane engine.

Nevertheless, the invention is also applicable to gas turbine combustion chambers for other aero-engines or for industrial turbines.

Figure 1:
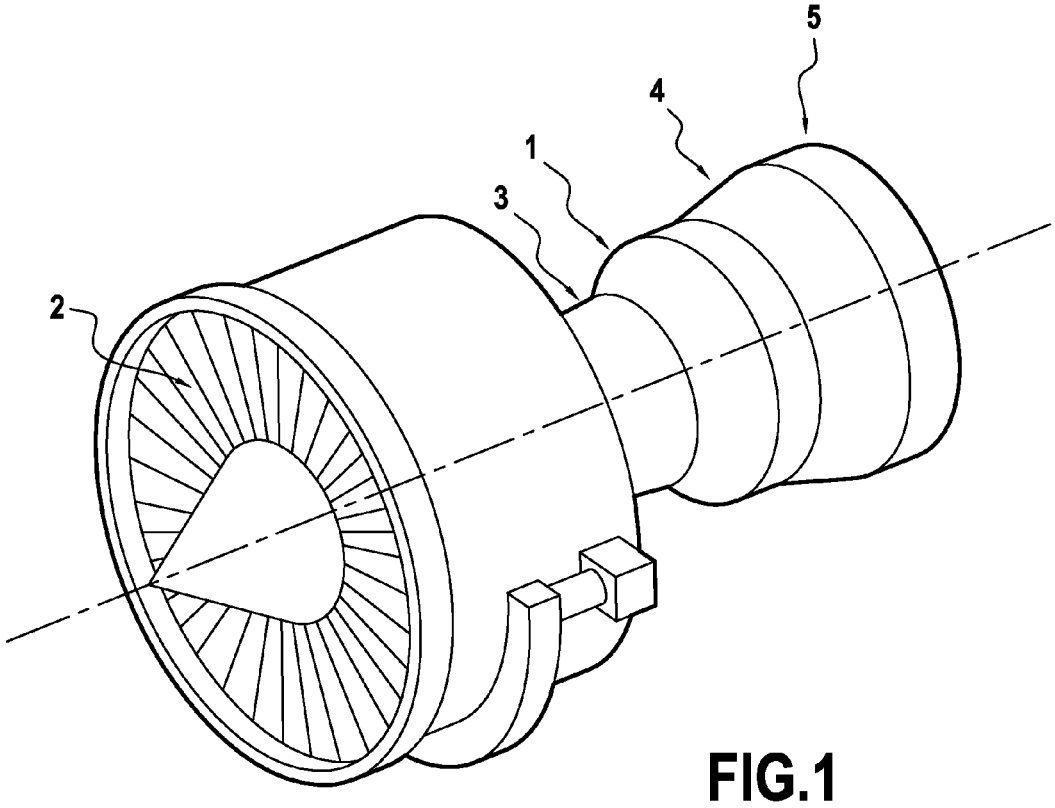
FIG. 1 is a highly diagrammatic view of a gas turbine airplane engine.

FIG. 1 is a highly diagrammatic view of a two-spool gas turbine airplane engine comprising, from upstream to downstream in the flow direction of the gas stream: a fan 2; a high pressure (HP) compressor 3; a combustion chamber 1; a high pressure (HP) turbine 4; and a low pressure (LP) turbine 5; the HP and LP turbines being connected to the HP compressor and to the fan by respective shafts.

Figure 2:
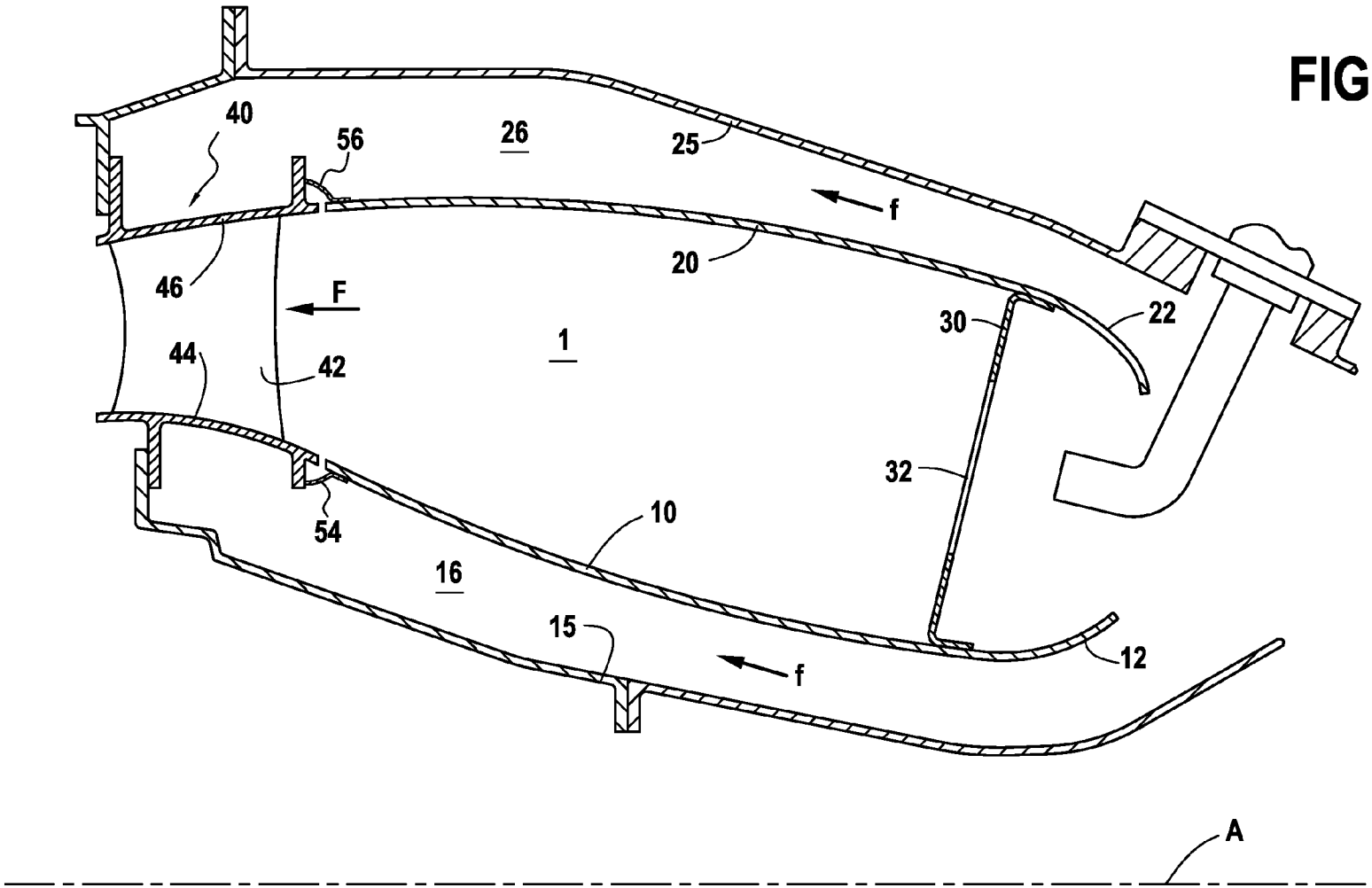
FIG. 2 is a highly diagrammatic section view of a combustion chamber and its surroundings in a gas turbine engine of the kind shown in FIG. 1, for example.

As shown very diagrammatically in FIG. 2, the combustion chamber is of annular shape about an axis A and it is defined by an inner annular wall 10, an outer annular wall 20, and a chamber end wall 30 that is connected to the inner and outer walls 10 and 20. The end wall 30 defines the upstream end of the combustion chamber and presents openings 32 that are distributed around the axis A for housing injectors (not shown) enabling fuel and air to be injected into the combustion chamber. Beyond the end wall 30, the inner and outer walls 10 and 20 are extended by respective inner and outer cowls 12 and 22 that contribute to channeling air that flows around the combustion chamber.

The inner and outer walls 10 and 20 of the combustion chamber are made of ceramic matrix composite (CMC) material. The end wall 30 may also be made of CMC, in which case it is preferably made of the same material as the inner and outer walls 10 and 20, or else it may be made of metal, since it is exposed to temperatures that are lower than those to which the inner and outer walls 10 and 20 are exposed.

The combustion chamber is supported between an inner metal casing 15 and an outer metal casing 25 by means of elastically-deformable link elements (not shown in FIG. 2) that connect the inner casing 15 to the inner wall 10 and the outer casing 25 to the outer wall 20. The flexible link elements extend in the spaces 16 and 26 between the casing 15 and the inner wall 10, and between the casing 25 and the outer wall 20, which spaces convey a stream of cooling air (arrows f) that flow around the combustion chamber. The flexibility of the link elements, e.g. made of metal, enables them to absorb the differential dimensional variations of thermal origin between the CMC chamber walls and the metal casings.

At its downstream end, the outlet from the combustion chamber is connected to the inlet of an HP turbine nozzle 40 that constitutes the inlet stage of the HP turbine. The nozzle 40 comprises a plurality of stationary vanes 42 distributed angularly around the axis A. The vanes 42 are secured at their radial ends to respective inner and outer walls or platforms 44 and 46 that have inside faces defining the flow duct through the nozzle 40 for the stream of gas coming from the combustion chamber (arrow F).

At the connection between the outlet from the combustion chamber and the inlet to the HP turbine nozzle, sealing is provided by inner and outer annular lips 54 and 56. The lip 54 has one end portion fastened to or bearing against the outer surface of the inner wall 10, and another end portion bearing against an annular rim of the wall 44. The lip 56 has one end portion fastened to or bearing against the outer surface of the outer wall 20 and another end portion bearing against an annular rim of the wall 46.

A combustion chamber assembly as described above is in itself known.

Figure 3:
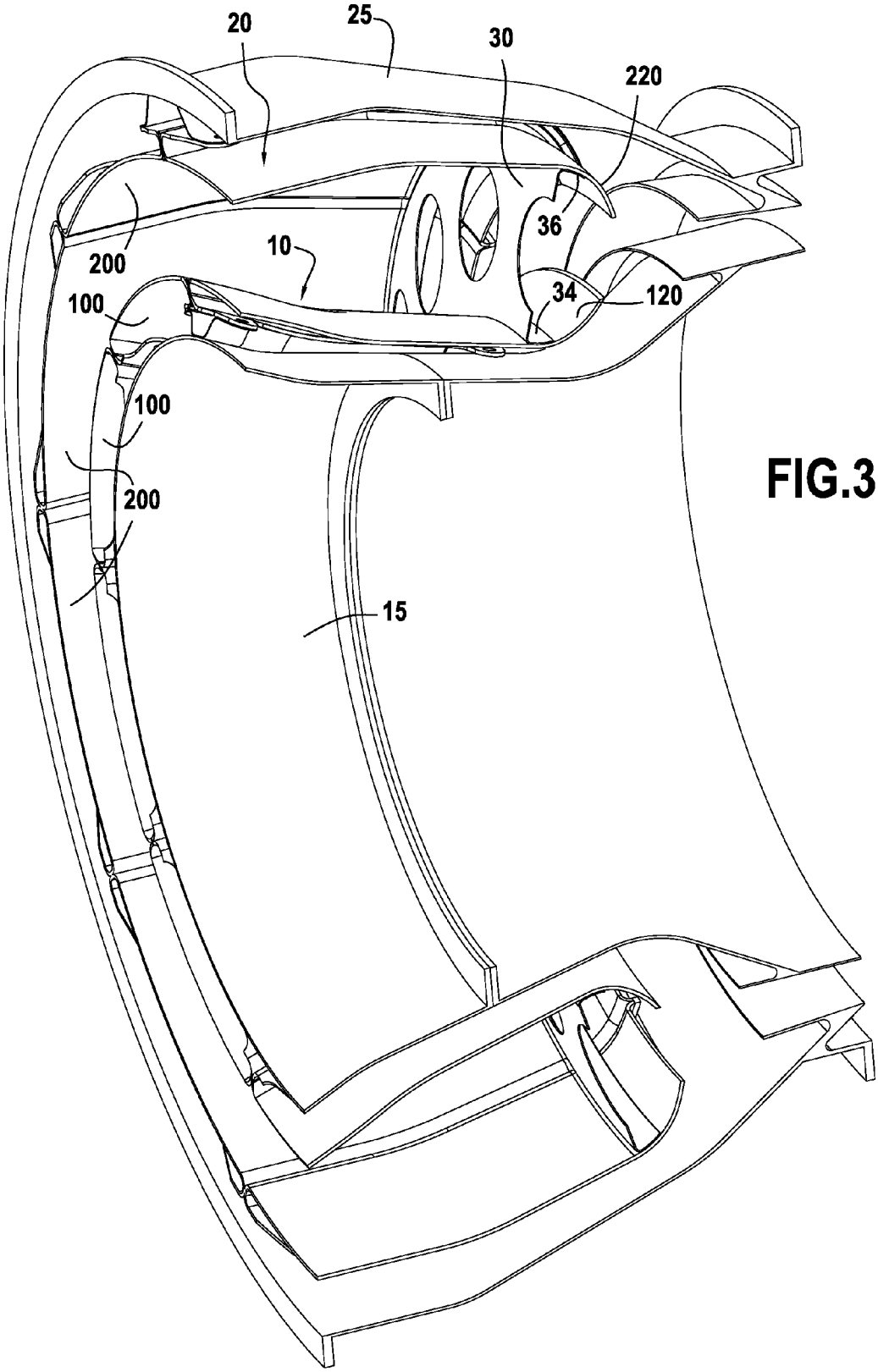
FIG. 3 is a partially cut-away perspective view seen from downstream showing a combustion chamber assembly in an embodiment of the invention.
Figure 4:
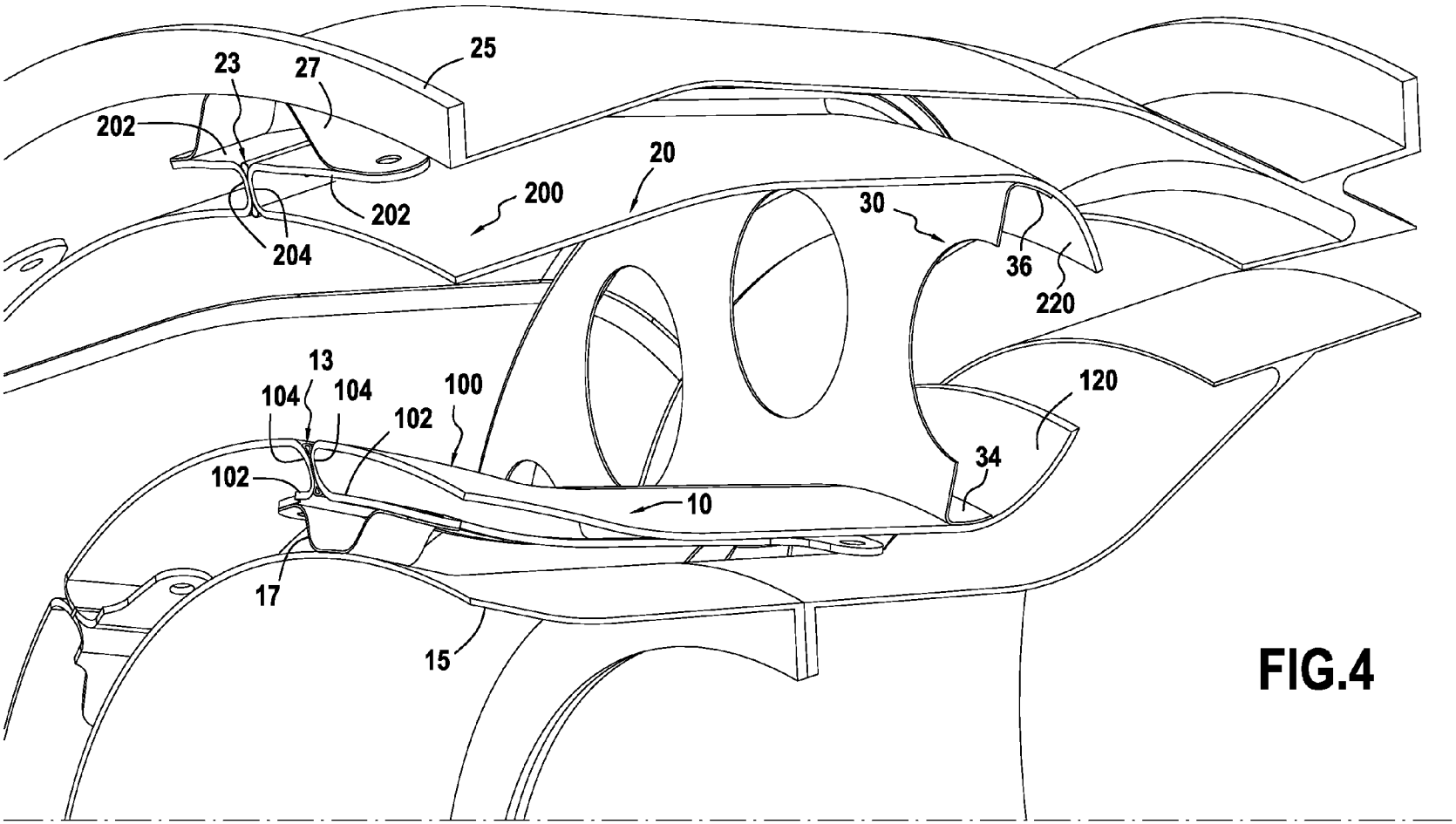
FIG. 4 is a fragmentary perspective view on a larger scale showing a portion of the FIG. 3 combustion chamber.
Figure 5:
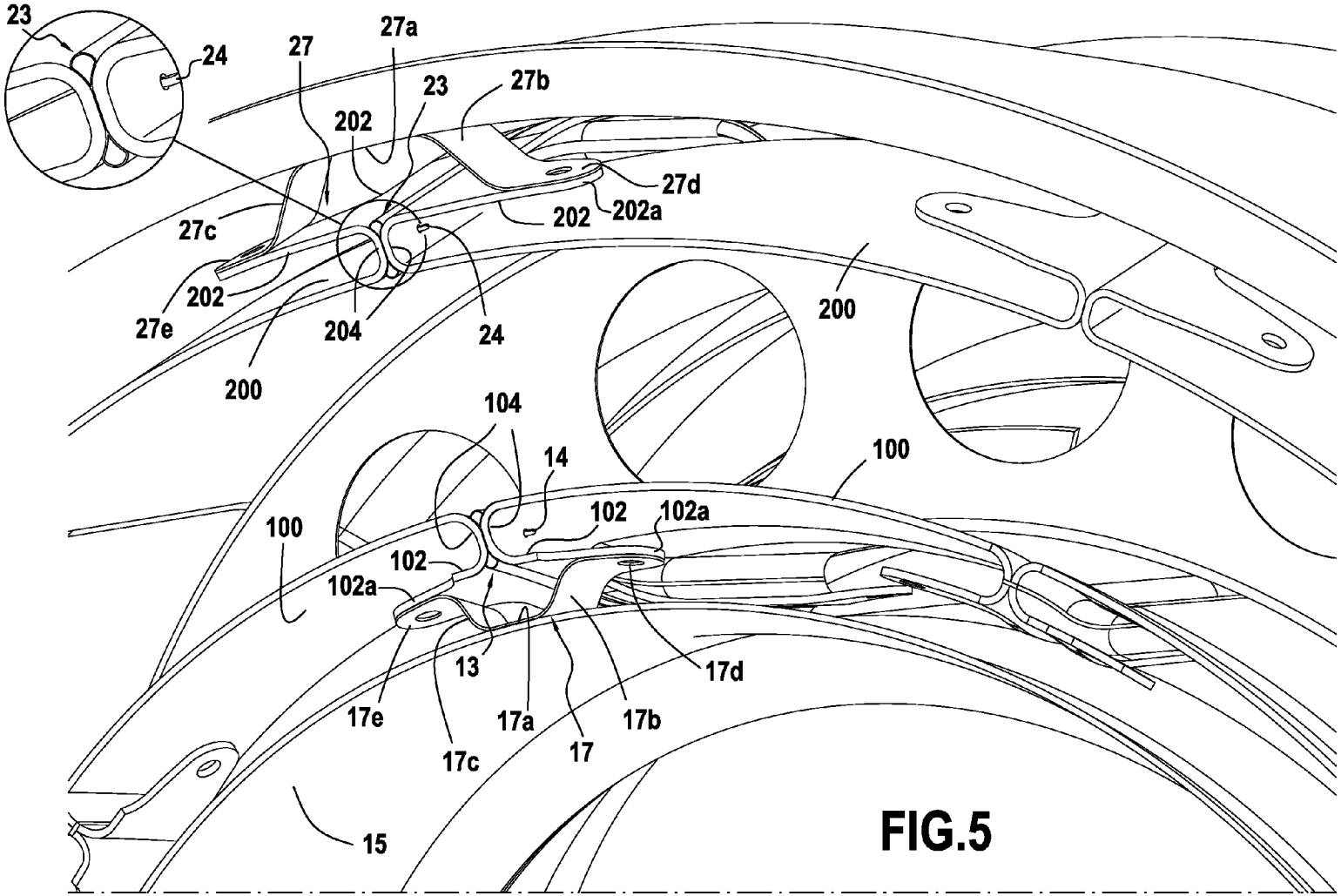
FIG. 5 is a perspective view showing details of FIG. 4 on an even larger scale.

As shown in FIGS. 3 to 5 and in accordance with the invention, the inner and outer walls 10 and 20 of the combustion chamber are subdivided circumferentially into respective adjacent sectors 100 and 200, each sector extending continuously over the entire axial length of the chamber, i.e. from the end wall of the chamber to the downstream end of the chamber.

Along their longitudinal edges, the sectors 100 are folded towards the outside of the chamber so as to form portions having a U-shaped cross-section and terminated by folded-back margins 102 that are spaced apart from the outside face of the inner chamber wall 10 and substantially parallel thereto. The margins 102 are connected to the remainder of the sectors 100 by rounded portions 104. Sealing gaskets 13 are interposed between the rounded portions 104 of the facing longitudinal edges of adjacent sectors 100. The gaskets 13 are held in place by means of pins 14 that pass through the rounded portions 104 via their tops and that also pass through the portions of the gasket 13 situated between said tops.

Along its inner edge, the chamber end wall 30 is folded upstream to form an annular flange 34 to which the sectors 100 are fastened by mechanical fastener elements such as screws or bolts (not shown).

The inner cowl 12 is likewise subdivided circumferentially into adjacent sectors 120 that are made integrally with the sectors 100 and that are formed by extending the sectors 100 upstream beyond the connection with the end wall 30. It should be observed that the longitudinal edges of the sectors 100 are extended circumferentially and folded back to form the rounded portions 104 and the margins 102 only in those portions of the sectors 100 that extend between the end wall 30 and the downstream end of the combustion chamber.

The connection between the inner wall 10 and the inner metal casing 15 is provided by elastically-deformable link elements 17 that also serve to hold the sectors 100 mutually in position. The link elements 17 are disposed in one or more circumferential rows, each margin 102 of a sector 100 being connected to the metal casing 15 by at least one link element. At least one circumferential row of link elements is provided in the vicinity of the downstream ends of the sectors 100, the sectors being fastened to the end wall 30 at the upstream end of the chamber. At least one other circumferential row may nevertheless also be provided in order to ensure good mutual retention between the sectors 100. In the example shown, a second circumferential row of link elements 17 is provided in the vicinity of the end wall of the chamber.

In the example shown, the link elements 17 are in the form of bridges presenting an Ω-(omega) shaped section with the tops 17*a* thereof being fastened to the inner metal casing 15 and with the branches 17*b* and 17*c* thereof terminating in feet 17*d* and 17*e* that are fastened of the outer faces of the adjacent margins 102 of two adjacent sectors 100. The link elements may be fastened to the metal casing 15 and to the margins 102 by bolting, screw-fastening, or riveting. It should be observed that for fastening the feet 17*d*, 17*e*, the margins 102 form tabs 102*a* (FIG. 5) that extend circumferentially over a greater distance than the remainder of the margins, the circumferential size of the margins 102 (apart from the tab-forming zones 102*a*) possibly being very small.

Along their longitudinal edges, the sectors 200 are connected together in leaktight manner to form the outer wall 20. In like manner to the sectors 100, the sectors 200 are folded outwards along their longitudinal edges to form portions having a U-shaped cross-section and terminated by folded-back margins 202 that are spaced apart from the outer face of the chamber outer wall 20 and that are substantially parallel thereto. The margins 202 are connected to the remainder of the sectors 200 by rounded portions 204. Sealing gaskets 23 are interposed between the rounded portions 204 and the facing longitudinal edges of adjacent sectors 200. The gaskets 23 are held in place by means of pins 24 in the same manner as the gaskets 13 being held in place by the pins 14.

Along its outer edge, the chamber end wall 30 is folded upstream to form an annular flange 36 to which the sectors 200 are fastened by mechanical fastener elements such as screws or bolts (not shown).

The outer cowl 22 is likewise subdivided circumferentially into adjacent sectors 220 that are made integrally with the sectors 200 and that are formed by extensions of the sectors 200 going upstream beyond their connection with the chamber end wall 30. It should be observed that the longitudinal edges of the sectors 200 are folded back to form the rounded portions 204 and the margins 202 only over that portion of the lengths of the sectors 200 that extend between the end wall 30 and the downstream end of the combustion chamber.

The connection between the outer wall 20 and the outer metal casing 25 is provided by elastically-deformable link elements 27 that also ensure mutual retention between the sectors 200. The link elements 27 are located in one or more circumferential rows in the same manner as the link elements 17, each margin 202 of a sector 200 being connected to the metal casing 25 via at least one link element.

In the example shown, the link elements 27 form Ω-section bridges similar to the link elements 17, each having a top 27*a* fastened to the metal casing 25 and branches 27*b*, 27*c* that terminate in feet 27*d* and 27*e* that are fastened to the outer faces of the adjacent margins 202 of two adjacent sectors 200. The link elements may be fastened to the metal casing 25 and to the margins 202 by bolting, screw-fastening, or riveting. In the same manner as the margins 102, the margins 202 form tabs 202*a* for fastening the feet 27*d* and 27*e* of the link elements 27, and the circumferential size of the margins 202 (outside the zones forming the tabs 202*a*) may be much smaller than the size of the tabs.

The sectors 100, 200 (each formed integrally with a sector 120, 220) are made of ceramic matrix composite material having fiber reinforcement made of refractory fibers densified by a ceramic matrix. The fibers of the fiber reinforcement may be of carbon or of ceramic, and an interphase, e.g. of pyrolytic carbon (PyC) or of boron nitride (BN), may be interposed between the reinforcing fibers and the ceramic matrix. The fiber reinforcement may be made by superposing fiber plies such as woven fabrics or sheets, or else by three-dimensional weaving. The ceramic matrix may be made of silicon carbide or of some other ceramic carbide, nitride, or oxide, and may also include one or more self-healing matrix phases, i.e. phases capable of healing cracks by taking on a pasty state at a certain temperature. CMC materials with self-healing matrices are described in documents U.S. Pat. Nos. 5,965,266, 6,291,058, and 6,068,930.

The interphase may be deposited on the reinforcing fibers by CVI. In order to perform ceramic matrix densification, it is possible to implement a CVI densification process or a liquid process, or indeed a reactive process (impregnation with a molten metal). Processes for making CMC parts are well known. In particular, a first densification stage may be performed by consolidating the fiber reinforcement while it is held in the desired shape by means of tooling, with densification subsequently being continued without such support tooling.

The chamber end wall 30 is made as a single annular part and it may be made of metal, with it being possible for the mechanical fastener elements between the sectors 100, 200 and the flanges 34, 36 of the end wall 30 to be made of metal since the connections they provide are provided in a "cold" zone.

The gaskets 13, 23 may be made in the form of a fiber structure made of refractory fibers. It is possible to use a non-densified fiber structure made of ceramic fibers, e.g. fibers of silicon carbide or of some other ceramic carbide, nitride, or oxide, the fiber structure being obtained by weaving or by braiding, for example. It is also possible to use a fiber structure made of refractory fibers (carbon fibers or ceramic fibers) that is densified at least in part by a ceramic matrix obtained by CVI or by a liquid process.

Figure 6:
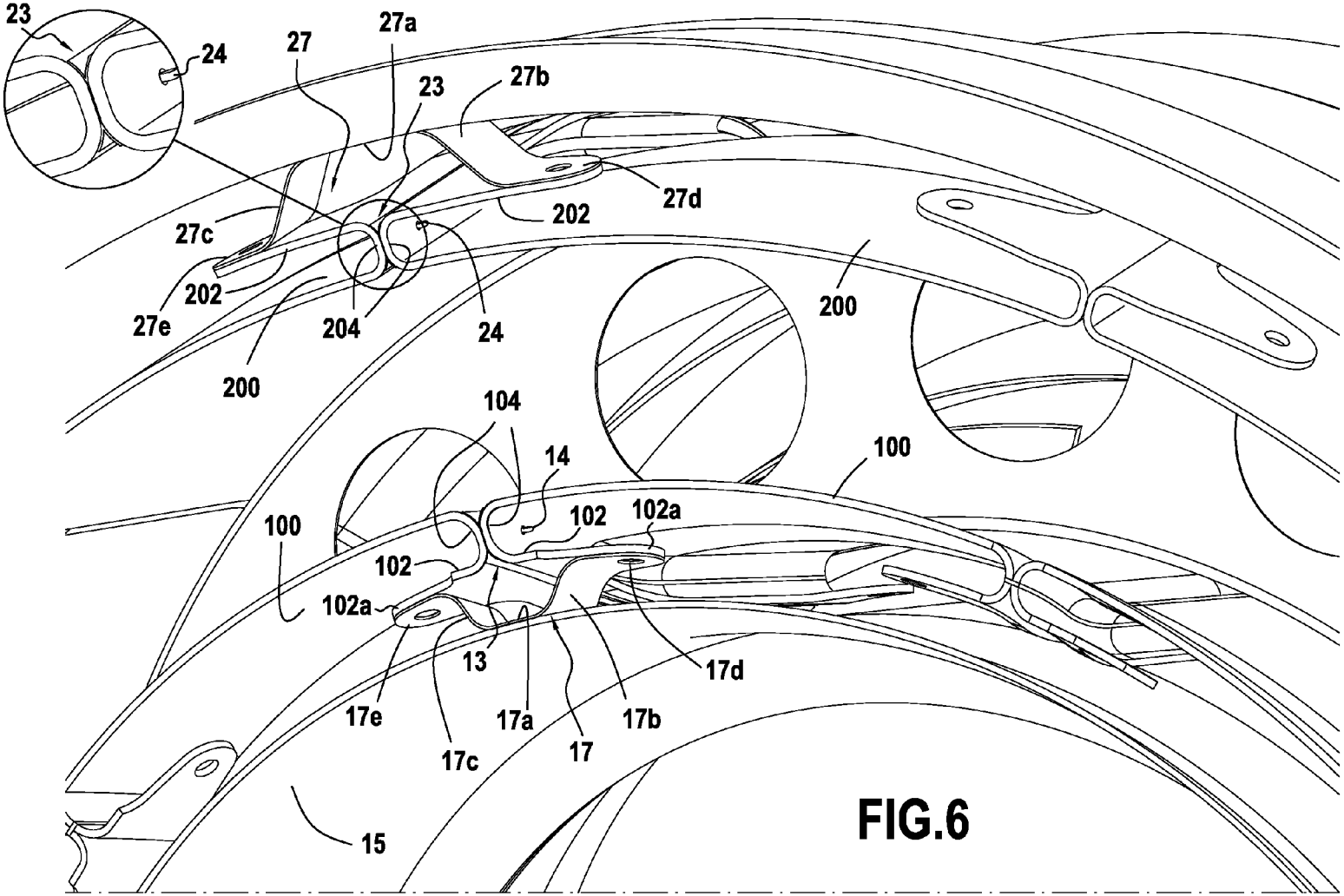
FIG. 6 is a view similar to FIG. 5 showing a variant embodiment of sealing gaskets.

In the embodiment of FIG. 5, the gaskets 13, 23 present an 8-shaped section. In a variant, and as shown in FIG. 6, the sealing gaskets 13, 23 may present an X-shaped section.

Since the gaskets 13, 23 are held in position by pins such as 14, 24 located in a "cold" zone in the spaces 16, 26, the pins may be made of metal.

The elastically-deformable link elements 17, 27 are made of metal of small thickness so as to impart desired flexibility thereto. It should be observed that it is possible to use link elements that are not common with two sectors 100 or 200, e.g. by connecting each tab 102*a*, 202*a* to the metal casing 15 or 25 via a particular flexible attachment. It should also be observed that the link elements between the sectors 100, 200 and the metal casings 15, 25 may be prestressed in order to exert a mutual bearing force between sectors 100, 200.

The mechanical connections between the link elements and the metal casings and between the link elements and the sectors 100, 200 may be provided by screws, bolts, or rivets that are made of metal since they are located in "cold" zones in the spaces 16, 26.

When a plurality of circumferential rows of link elements 17, 27 are provided, the elements of one of the rows, e.g. the row closest to the downstream end of the chamber, are fastened to the margins 102, 202 and to the metal casings 15, 25 without any slack, while the elements of the or each other row are fastened with slack in the longitudinal direction in order to accommodate differential dimensional variation in said direction.

The flexibility of the link elements 17, 27 in combination with the ability of the margins 101, 202 of the sectors 100, 200 to deform elastically, in particular via the tabs 102*a*, 202*a*, makes it easy to compensate for the differential dimensional variations of thermal origin that occur between the CMC walls 10, 20 and the metal casings 15, 25.

Figure 7:
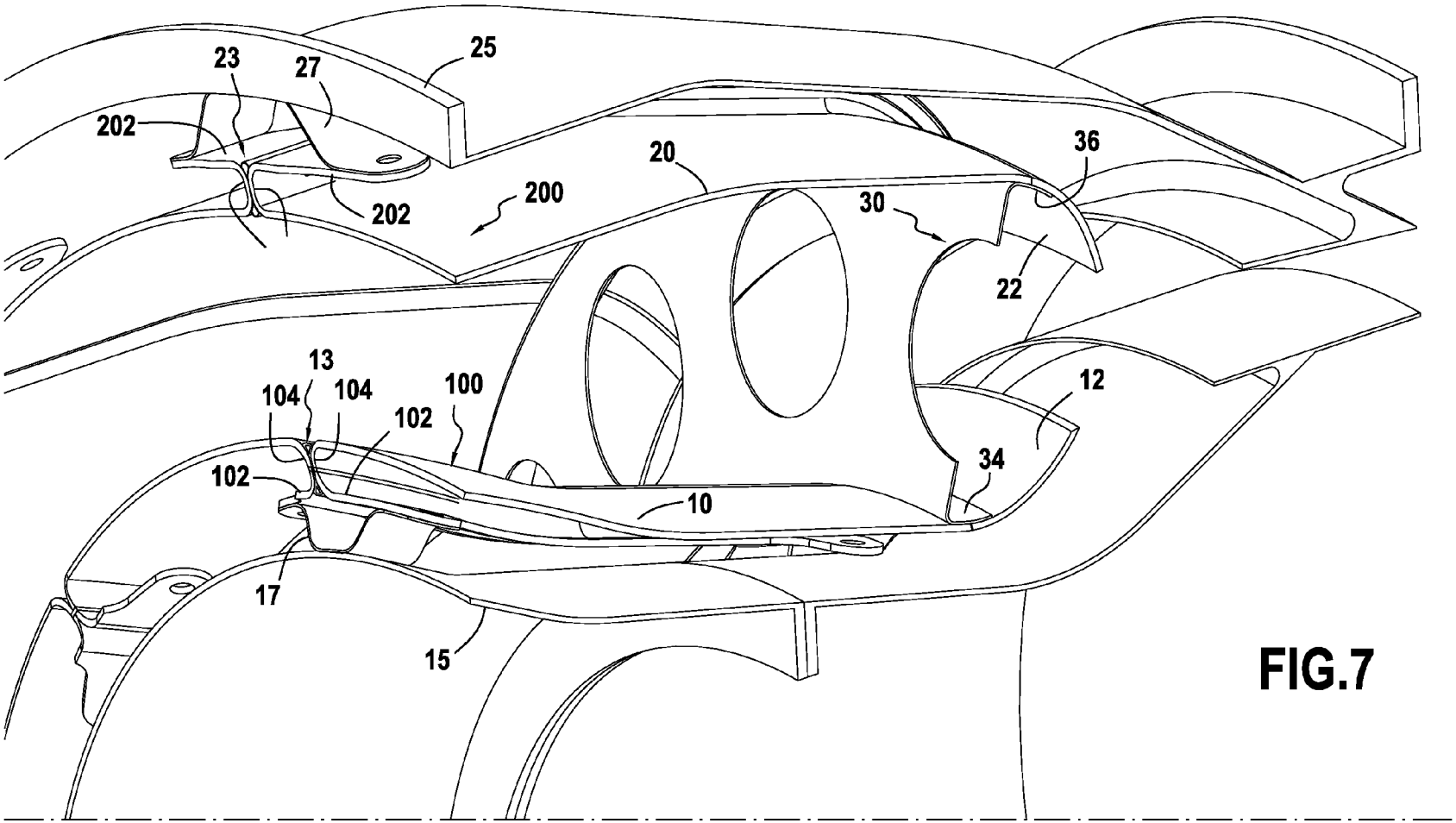
FIG. 7 is a perspective view similar to FIG. 4 showing a variant embodiment of cowls extending the walls of the combustion chamber upstream from the end wall thereof.

FIG. 7 shows a variant embodiment in which the cowls 12, 22 are made separately from the sectors 100, 200. The cowls 12, 22 may then be made of metal and they may be made as respective single pieces. They are fastened to the flanges 34, 36 of the chamber end wall 30, e.g. by means of metal bolts or screws, in the same manner as the upstream ends of the sectors 100, 200.

Figure 8:
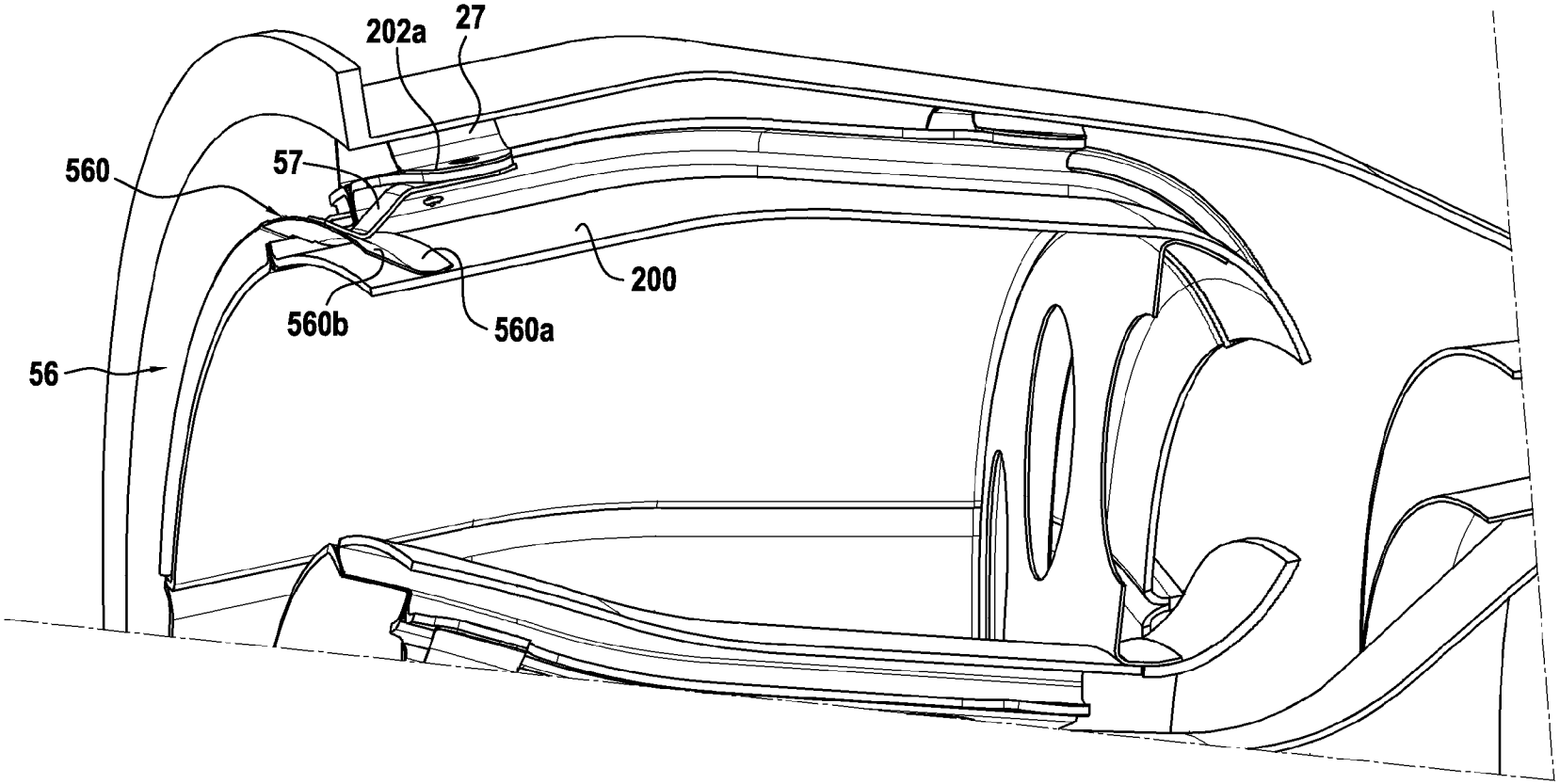
FIG. 8 is a fragmentary view showing an embodiment of sealing between the outlet from the combustion chamber and the inlet of a high pressure turbine nozzle.

One way of providing sealing between the downstream end of the combustion chamber and the turbine nozzle is shown in FIG. 8.

The annular sealing lip 56 is made of metal, for example. It is subdivided circumferentially into adjacent sectors 560 in the same manner as the outer walls 20. The upstream portion 560*a* of each lip sector 560 is fastened to or bears against the outer surface of a corresponding wall sector 200. Fastening may be provided by brazing. From the upstream portion 560*a*, the lip sector 560 extends downstream, forming a portion 560*b* that departs progressively from the outer surface of the wall sector 200.

A flexible metal tongue 57 has one end fastened to the connection tab 202*a* situated in the vicinity of the downstream of the wall sector 200, where fastening may be provided in common with fastening to a bridge foot 27. At its other end, the flexible tongue 57 bears against the portions 560*b* of the lip sector 560. The tongue 57 is prestressed in bending so as to exert a resilient force on the lip sector 560 and bear simultaneously against the outer face of the wall sector 200 and against the annular rim of the wall 46 of the turbine nozzle (FIG. 2).

The inner annular sealing lip 54 is subdivided circumferentially into adjacent sectors in the same manner as the lip 56, each lip sector being fastened to or bearing against a corresponding wall sector 100 and being associated with a metal tongue in the same manner as the lip sectors 560.

In the embodiments described, the number of sectors forming each of the inner and outer walls of the combustion chamber depends in particular on the capacity of the CMC material fiber reinforcement to deform, thereby enabling it to adapt to the shape of a sector while it is being fabricated.

Consequently, the number of sectors may be greater when the fiber reinforcement presents lesser deformability or when the deformation that is to be imposed thereon is greater, particularly if the cowls are incorporated in the sectors, as in the embodiment of FIGS. 2 to 6.

Thus, the number of sectors for each chamber wall may be selected in such a manner that each sector occupies an angle corresponding to one or more times the angular pitch of the injector housings in the chamber end wall, for example, one, two, or three times the angular pitch of the injector housings.

In the examples shown, the number of sectors is equal to the number of injector housings.

What is claimed is:

1. A gas turbine combustion chamber assembly comprising: an inner metal casing; an outer metal casing; an annular combustion chamber having an inner wall and an outer wall of ceramic matrix composite material and a chamber end wall connected to the inner and outer walls; and elastically-deformable link elements connecting the inner wall and the outer wall of the chamber respectively to the inner metal casing and to the outer metal casing, wherein each of the inner and outer walls of the chamber is subdivided circumferentially into adjacent sectors along longitudinal edges, each sector extending continuously from the chamber end wall to the opposite end of the chamber, each sector being folded outwards from the chamber via each of its longitudinal edges so as to form a portion having a U-shaped cross-section, each terminated by a folded-back margin that is spaced apart from the outer face of the corresponding chamber wall, and the link elements are connected to the inner and outer walls of the chamber by being fastened to the margins of the sectors.

2. An assembly according to claim 1, wherein the link elements are in the form of bridges of substantially omega-shaped section, each bridge having a top that is connected to one of the inner and outer metal casings, and feet that are connected to adjacent margins of two adjacent sectors of the corresponding inner or outer chamber wall.

3. An assembly according to claim 1, wherein the link elements are fastened to the outer faces of the margins of the sectors.

4. An assembly according to claim 1, wherein each inner or outer chamber wall sector is connected via each of its margins to the corresponding inner or outer metal casing by means of a first and at least one second link element, and the connection between the or each second link element and the corresponding chamber wall sector margin is provided with slack in the longitudinal direction.

5. An assembly according to claim 1, wherein sealing gaskets are interposed between adjacent inner or outer chamber wall sectors.

6. An assembly according to claim 5, wherein the gaskets are interposed between facing rounded portions of the folded-back longitudinal edges of two adjacent sectors.

7. An assembly according to claim 6, wherein elements are provided for holding each gasket in the longitudinal direction relative to the longitudinal edges of the chamber wall sectors between which the gasket is placed.

8. An assembly according to claim 5, wherein each gasket presents a section of X- or 8-shape.

9. An assembly according to claim 5, wherein each gasket comprises a fiber structure of refractory fibers.

10. An assembly according to claim 9, wherein the fiber structure is densified at least in part by a ceramic material.

11. An assembly according to claim 1, wherein the chamber end wall includes inner and outer annular flanges having the inner and outer chamber wall sectors connected thereto.

12. An assembly according to claim 1, wherein each chamber wall sector is made integrally with a portion forming a cowl sector that extends upstream from the connection between the sector and the chamber end wall.

13. An assembly according to claim 1, wherein cowl-forming portions extend the inner and outer chamber walls upstream from the connection with the chamber end wall, which cowl-forming portions are distinct from the chamber wall sectors and are fastened to the inner and outer annular flanges of the chamber end wall.

14. A gas turbine engine including a combustion chamber according to claim 1.

* * * * *